United States Patent [19]

Cibié et al.

[11] Patent Number: 4,686,610

[45] Date of Patent: Aug. 11, 1987

[54] MOTOR VEHICLE HEADLAMPS PROJECTING A MASKED BEAM, IN PARTICULAR A DIPPED BEAM

[75] Inventors: Pierre Cibié; Norbert Brun, both of Bobigny, France

[73] Assignee: Cibie Projecteurs, France

[21] Appl. No.: 749,571

[22] Filed: Jun. 27, 1985

[30] Foreign Application Priority Data

Jun. 27, 1984 [FR] France ..... 84 10150

[51] Int. Cl.[4] ..... F21V 11/00

[52] U.S. Cl. ..... 362/61; 362/307; 362/351

[58] Field of Search ..... 362/61, 268, 307, 311, 362/351

[56] References Cited

U.S. PATENT DOCUMENTS 1,928,431 9/1933 Morshead et al. ..... 362/268
4,517,630 5/1985 Dieffenbach et al. ..... 362/268

FOREIGN PATENT DOCUMENTS 0374911 6/1932 United Kingdom .
450348 7/1936 United Kingdom .
1550336 8/1979 United Kingdom ..... 362/268

*Primary Examiner*—Craig R. Feinberg
*Assistant Examiner*—David A. Okonsky

[57] ABSTRACT

The invention relates to a masked beam motor vehicle headlamp of the type comprising, in succession: a reflector (1); a light source (3); a masking screen (E) having a cutoff edge (A); and a converging lens (4). The headlamp is characterized in that the screen is fitted, beneath its cutoff edge (A) and at least in its central portion, with an opening suitable for allowing a portion of the light flux directed towards the screen to pass therethrough. Means are provided to direct said light flux passing through said opening so that it is combined with the light flux which is not intercepted by the screen, thereby improving the light characteristics of the masked beam as finally projected by the headlamp.

12 Claims, 6 Drawing Figures

MOTOR VEHICLE HEADLAMPS PROJECTING A MASKED BEAM, IN PARTICULAR A DIPPED BEAM

The present invention relates to motor vehicle headlamps projecting a masked beam, and particularly, but not exclusively, to dipped headlamps projecting an intense light beam below a cutoff limit.

BACKGROUND OF THE INVENTION

For a dipped beam, such a cutoff or masking limit may, for example, be constituted by two half planes passing through the optical axis of the headlamp such that for right-hand drive the left half plane is substantially horizontal and the right half plane is slightly inclined to the horizontal. This arrangement is defined in the French Highway Code and in the European standards laid down in the Geneva regulations. In other countries, for example in the United States, sealed beam type headlamps are masked by means of two half planes which are horizontal and which extend on either side of the light axis. "Z-masked" beams are also known.

More precisely, the present invention relates to masked beam headlamps of the type comprising a reflector, a light source, a masking screen provided with a masking edge, and a converging lens. In a typical embodiment:

the reflector is at least partially in the form of an ellipsoidal cap which is circularly symmetrical about an axis defining an optical axis, with the two focuses of the ellipsoid defining a first focus close to the reflector and a second focus further away therefrom;

the light source is disposed in the vicinity of the first focus of the reflector;

the converging lens is disposed with its optical axis coinciding with the optical axis of the reflector, with its focus in the vicinity of the second focus of the reflector, and on the opposite side of said second focus to the reflector; and the masking screen is disposed in the vicinity of the lens focus and its masking edge is close to the optical axis.

Such a structure has been known for a long time, and is described, for example, in British patent certification No. 450 348 which was published in 1936.

In practice, such optical systems have been very little used for motor vehicle headlamps, and the Applicant has recently taken an interest in such systems.

Generally speaking, the Applicant has observed that simply implementing the teaching of the prior art as it stands does not enable a headlamp to be obtained capable of satisfying modern requirements of motor vehicle manufacturers and modern regulatory standards.

The Applicant has observed that the essential problem lies in the way the masking screen is made.

In the prior art these screens are simply plane or substantially plane opaque masks of uniform thickness whose top edges define a masking or cutoff limit.

Tests performed by the Applicant have shown that such a screen in a headlamp of the above-mentioned type is inherently subjected to two serious defects: in brief, the system provides too sharp a cutoff, and provides too little light above the cutoff limit.

The first drawback is particularly apparent when the driver of a vehicle fitted with such dipped headlamps brakes suddenly. In this case, the vehicle tips forwardly and the distance of visibility provided by the headlamps is suddenly reduced to a few meters. By virtue of the total absence of any light above the cutoff limit, the driver has the impression of a "black hole" and is subjected to the well-known risks of such a situation.

Further, the absence of any light above the cutoff limit makes it impossible to read some kinds of road sign.

Finally, simple opaque masking thus turns out to unacceptable in practice for making a headlamp which satisfies French and European standards.

The same is true of headlamps for American standards, and in particular for masked beam standards applicable to "sealed beam" type lamps which do not allow for such a sharply marked cutoff.

The problem is thus to obtain a satisfactorily masked beam with headlamps of the above-defined structure. The invention provides a set of solutions to this problem.

SUMMARY OF THE INVENTION

According to the invention a masked beam headlamp of the above-defined type has a screen which possesses the following set of characteristics:

(a) it is provided beneath the cutoff edge and at least in its central portion, with a transverse opening which is substantially horizontal and which is suitable for allowing a portion of the light flux striking the screen to pass therethrough;

(b) a portion of the screen facing the lens and situated between the cutoff edge and the said opening is made reflective, and preferably diffusing; and (c) a light recovery element is disposed in front of said opening for recovering the flux which passes therethrough and for returning said flux towards said reflecting portion which diverts it to join the flux which is not intercepted by the screen, thereby improving the light distribution characteristics of the masked beam as finally projected by the headlamp.

Preferably, the general shape of the screen is curved to correspond to the curvature of the field of the converging lens. In other words the screen is curved in such a way as to compensate for the effects of lens field curvature such that in spite of said field curvature the cutoff limit projected on a standardized screen placed at 25 meters from the headlamp (as laid down by French standards) remains constituted by two half planes. Curving the screen in this way gives it a curved edge which causes a clean projection to appear on the screen in spite of the lens field curvature.

Numerous embodiments of the invention are possible.

In a first embodiment the reflecting portion is provided below the edge of a thin screen of opaque material, e.g. metal. In order to give it the required reflecting and diffusing characteristics, the screen is subjected to surface treatment to give it a shiny and ground-glass like surface.

The element for recovering and concentrating flux is preferably elliptical in profile having one focus situated in the top half of said opening, and a second focus disposed close to the edge of the screen.

In another embodiment the screen, or at least its top portion, is made of a transparent material such as quartz and the reflecting portion and the light recovery portion are constituted by reflecting facets.

BRIEF DESCRIPTION OF THE DRAWINGS

Embodiments of the invention are described by way of example with reference to the accompanying drawings, in which.

MORE DETAILED DESCRIPTION

In all of the figures, in order to facilitate understanding, the main direction of the light beam projected by the elliptical headlamp to which the invention is applied is marked by an arrow L.

Figure 1:
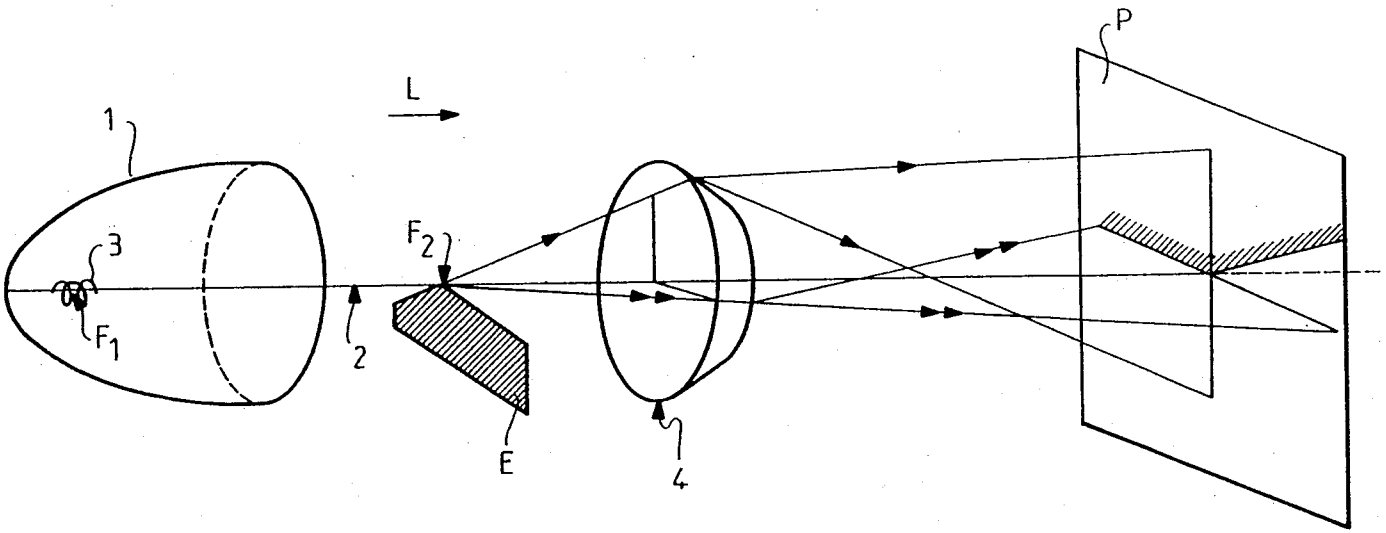
FIG -1 PRIOR ART
FIG. 1 is a perspective view of a headlamp including an elliptical reflector, a screen and a converging lens, and suitable for having the invention applied thereto.

The conventional structure of an elliptical headlamp for providing a masked beam is shown in FIG. 1. It comprises an elliptical reflector 1 in the form of a cap which is circularly symmetrical about an optical axis 2 and having two focuses F1 (close to the bottom of the reflector 1) and F2 (further away). A light source 3 (a filament) is disposed in the vicinity of the first focus F1. Light rays from the light source 3 are reflected by the reflector 1 towards the second focus F2.

A converging lens 4 is disposed on the other side of the focus F2 away from the reflector 1. The optical axis of the lens coincides with the axis 2 of the reflector, and the focus of the lens is itself located in the vicinity of the focus F2. Thus, light rays emitted from the light source 3 are reflected by reflector 1 and converge in the vicinity of the focus F2, from which they are taken by the lens 4 to constitute a useful beam.

In order to emit a masked beam in this way, masking means, and more precisely a masking screen E is disposed in the vicinity of the focus F2. The screen E has a top edge defining the cutoff limit of the beam. In the example shown in FIG. 1, the screen E is plane and perpendicular to the axis 2, and the cutoff edge is constituted by two half planes meeting at the optical axis. A projection plane P is placed at 25 meters from the headlamp and it can be seen on the plane P that the edge of the screen defines a cutoff limit which is horizontal to the left and which rises at 15° to the right, in accordance with French and European standards.

With such a headlamp structure, it is possible, in theory, to provide various kinds of cutoff depending on the shape of the top edge of the opaque screen. By way of example, the above description relates to a shape comprising two half planes which correspond to the cutoff defined by French and European standards. For a "sealed beam" type of cutoff, the edge of the opaque screen should be substantially horizontal.

The Applicant has observed that in both cases the results obtained in this way are not satisfactory given the current requirements of standards and of manufacturers. Firstly it is observed that the cutoff provided by an opaque screen is too sharp, thereby giving rise to a "black hole" effect when braking, as explained above. Secondly the opaque character of the mask completely suppresses any light above the cutoff in the projected beam, thereby making it very difficult to see and read some kinds of road sign. It is extremely desirable to remedy these two drawbacks.

The Applicant's solution consists, as explained above, in providing an opening in the screen beneath its cutoff edge to allow light to pass, in providing a reflecting portion immediately below the edge of the screen (and preferably in making said reflecting portion a diffusing portion as well), and in disposing a flux recovery system which co-operates both with said opening and with said reflecting portion to cause additional flux to be projected forwardly in a manner which provides the desired addition to the light flux which is not intercepted by the screen.

Figure 2:
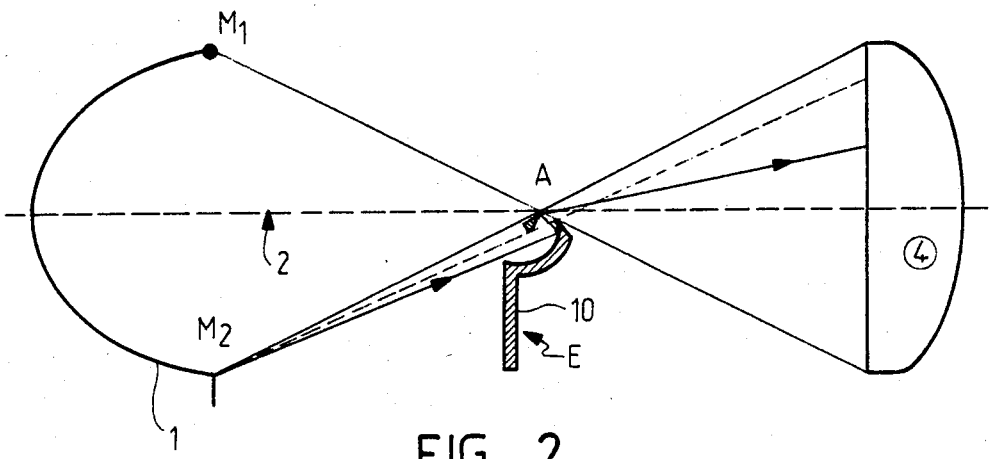
FIG. 2 is a diagrammatic axial vertical section through an improved projector in accordance with the invention.
Figure 3:
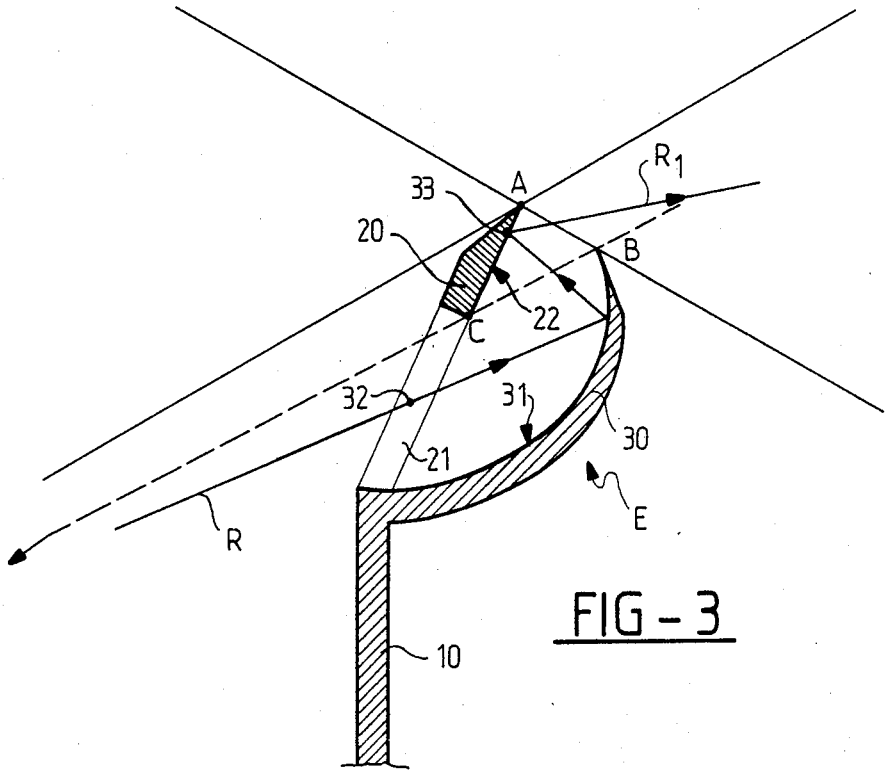
FIG. 3 is an axial vertical section on a larger scale than FIG. 2 showing the screen of a headlamp in accordance with the invention.

FIGS. 2 and 3 show a first embodiment of the invention.

The characteristic of the invention lies in the special structure of the screen E. All the other components of the headlamp remain unchanged, and are therefore designated in FIG. 2 by the same references.

A screen E in accordance with the invention has a lower portion 10 in the form of a conventional vertical sheet. The upper portion 20 of the screen is slightly inclined to the vertical (e.g. at 25°) and tapers upwardly to terminate in a knife-edge A which constitutes the cutoff edge.

The said upper portion 20 also has a horizontal slot 21 therethrough enabling flux to pass freely beneath the cutoff edge constituted by the knife-edge A.

The front face of the upper portion 20 situated above the slot 21 is treated to constitute a reflecting surface 22, which surface is preferably, but not necessarily, also a diffusing surface. Such a surface 22 may be obtained, for example, by providing it with a coating of shiny metal and then grinding the surface slightly.

Finally, a light-recovery reflector element 30 extends in front of the slot 21, which element 30 is advantageously elliptical in shape, being provided with an elliptical reflecting face 31 looking towards the slot 21 and it, too, is terminated by a tapering knife-edge B.

More precisely, the elliptical reflector 30 possesses two focus lines 32 and 33, one of which coincides with the horizontal line passing through the middle of the slot 21, and the other of which follows the reflecting surface 22 slightly beneath the cutoff edge A and parallel thereto.

Figure 4:
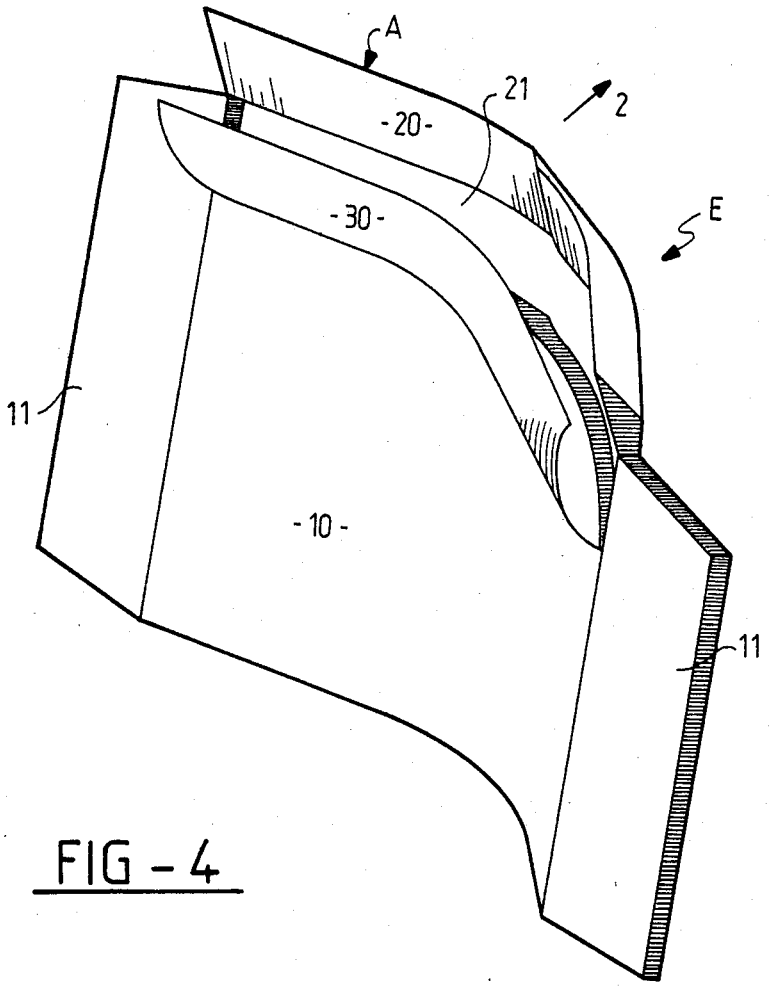
FIG. 4 is a perspective view of an improved screen for a headlamp in accordance with the invention, showing a first embodiment corresponding to FIGS. 2 and 3.

It must be understood that FIG. 3 is a vertical section of the middle of the screen E to a larger scale than FIG. 2. The shape of the screen as a whole can be seen more clearly in the perspective view of FIG. 4 which shows the front of the screen (where the light beam is taken as being projected forwardly, in other words FIG. 4 shows the portion of the screen which is mostly in the shade when the headlamp is turned on). It can be seen that the assembly constituted by the central portion of the vertical sheet 10, the top knife-edge portion 20, and the reflecting portion 30 is slightly curved to correspond with the field curvature of the lens 4. The corresponding curved shape of the knife-edge A ensures that the image thereof as projected on a plane at 25 meters from the headlamp follows a clean line, in spite of the field curvature of the lens. On either side of its central curved portion, the vertical sheet 10 is flanked by wings 11 which have little masking effect. Such a screen may be made in any suitable manner using any suitable material. Advantageously it is made from metal sheet and from a single piece of metal sheet which is cut and stamped to have the shape shown in FIG. 4.

Now that the structure of the screen E in accordance with the invention has been explained, its optical effects are easy to understand.

As explained above the knife-edge A acts as the cutoff edge of the screen E. However, without the other arrangements such a knife-edge would give rise to too sharp a cutoff causing there to be too little light above the cutoff line in the traffic direction (i.e. to the right as shown).

By virtue of the invention light flux as symbolized by a ray R passes through the slot 21 and is reflected by the reflector element 30 which returns it to the reflecting face 22 which in turn returns it in a forwards direction to contribute to the masked beam (i.e. leaves via $R_1$).

For optimum operation, the straight line extending in the central vertical plane of FIG. 2 and connecting the knife edges A and B passes through the highest point $M_1$ of the elliptical mirror 1.

Similarly, the straight line in the same central vertical plane which connects the knife-edge B of the light recovery mirror 30 and the top edge C of the slot 21 advantageously passes through the lowest point $M_2$ of the mirror. Thus, the most economical possible use is made of the additional flux passing through the slot 21 without the arrangements in accordance with the invention changing the normal optical role of the knife-edge A.

As has been explained above, the additional light flux after passing through the slot 21 and being reflected by the reflector element 30 (which acts as a flux concentrator), and then reflected a second time by the reflecting face 22 serves to overcome the lack of light in the masked portion of the beam. The rays $R_1$ contribute to the masked beam and provide illumination above the cutoff limit in the forward direction. Advantageously, the surface 22 is also made to diffuse light in order to increase the unfocused effect of the cutoff.

Naturally, the example of FIGS. 3 and 4 is not limiting.

Figure 5:
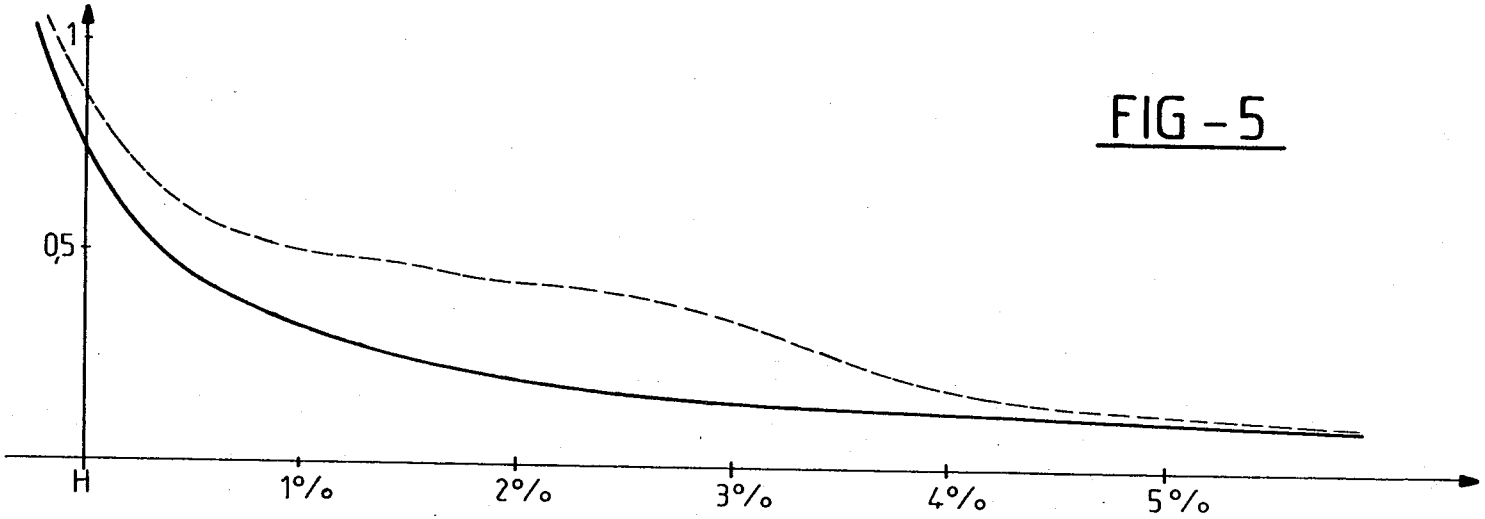
FIG. 5 is a graph showing two photometric curves taken with a screen provided with a slot in accordance with the invention (dashed line) and with an un-slotted screen (continuous line)

FIG. 5 is a graph showing two photometric curves obtained using a screen fitted with a slot in accordance with the invention (the dashed line curve) and with an identical screen which is not slotted (solid line).

The graph shows illumination (measured in lux) as a function of angle above the horizontal H. It can be seen that the solution in accordance with the invention serves to reduce the excessive sharpness of the cutoff and to provide some light above the cutoff. Angles are given in % (hundredth of radian).

Figure 6:
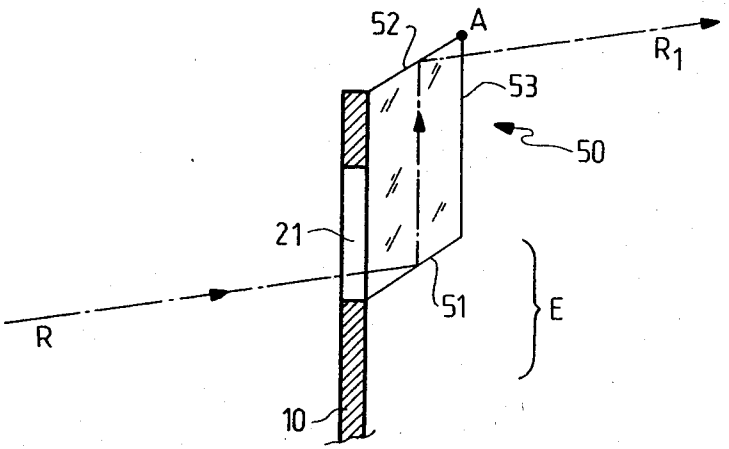
FIG. 6 is an axial vertical section through a second embodiment of the invention.

FIG. 6 shows a second embodiment of the screen in a view similar to FIG. 3. In this embodiment, the screen E comprises a plate 10 having a slot 21 therethrough.

A transparent system 50 is placed in front of the slot 21 (where the forward direction is defined by the direction in which the beam is projected). The transparent system 50 is quartz or the like and has a first reflecting facet 51, a second reflecting facet 52, and an outlet face 53.

The facet 52 intersects the outlet face 53 along an edge which constitutes the cutoff edge A. This cutoff edge acts as though it were the edge of the screen.

Further, as can be seen in the Figure, light rays R passing through the window 21 are reflected twice, once on the facet 51 and the second time on the facet 52 to leave along a ray $R_1$ to supply additional illumination above the cutoff line (like the rays $R_1$ of FIG. 3).

In this second embodiment, the facet 51 acts as the flux recovery element for light rays that pass through the slot, while the facet 52 acts as the reflective portion of the screen.

Advantageously, the facets 51 and 52 may be slightly curved.

Naturally the two embodiments which have been described are merely preferred examples of the numerous embodiments which are covered by the invention.

We claim:

1. A masked beam motor vehicle headlamp comprising, in succession: a reflector; a light source; a masking screen having a cutoff edge; and a converging lens; wherein the screen is provided beneath the cutoff edge with an opening which extends at least over a central portion of the screen and which is suitable for allowing a portion of a light flux directed toward the screen to pass therethrough; and wherein means are provided to direct a flux passing through said opening to be combined with the flux which is not intercepted by the screen thereby improving the light distribution characteristics of the masked beam as finally projected by the headlamp.

2. A headlamp according to claim 1, wherein a portion of the screen facing the lens and situated between the cutoff edge and said opening is made reflective, and wherein a flux recovery element is disposed ahead of said opening to recover the flux passing therethrough and to return it toward said reflective portion.

3. A headlamp according to claim 2, wherein said reflective portion of the screen is also a diffusing portion.

4. A headlamp according to claim 2, wherein the flux recovery element has an elliptical profile with a first focus situated in the center of the said opening and with a second focus disposed in a vicinity of the cutoff edge of the screen.

5. A headlamp according to claim 1, wherein the screen is made of cut and stamped metal sheet.

6. A headlamp according to claim 1, wherein a top portion of the screen includes a slot having a doubly reflecting optical element mounted forwardly therefrom, said optical element having a first reflecting facet for recovering light flux passing through said slot and for sending it via a second reflecting facet to pass out from the optical element via an outlet face.

7. A headlamp according to claim 6, wherein said optical element defines said cutoff edge.

8. A headlamp according to claim 6, wherein said optical element is made of quartz.

9. A headlamp according to claim 1, wherein the general shape of said screen is curved to correspond to a field curvature of said lens.

10. A headlamp according to claim 3, wherein the flux recovery element has an elliptical profile with a first focus situated in a center of the said opening and with a second focus disposed in a vicinity of the cutoff edge of the screen.

11. A headlamp according to claim 7, wherein said optical element is made of quartz.

12. A headlamp according to claim 6, wherein the general shape of said screen is curved to correspond to a field curvature of said lens.

* * * * *